United States Patent [19]

Durrant

[11] 4,455,835

[45] Jun. 26, 1984

[54] THERMAL ENERGY STORAGE AND RECOVERY APPARATUS AND METHOD FOR A FOSSIL FUEL-FIRED VAPOR GENERATOR

[75] Inventor: Oliver W. Durrant, Akron, Ohio

[73] Assignee: The Babcock & Wilcox Company, New Orleans, La.

[21] Appl. No.: 458,675

[22] Filed: Jan. 17, 1983

[30] Foreign Application Priority Data

Nov. 11, 1982 [WO] PCT Int'l. Appl .. PCT/US82/01597

[51] Int. Cl.[3] ..... F01K 3/00; F28D 13/00

[52] U.S. Cl. ..... 60/659; 60/652; 60/676; 165/104.13; 165/104.18

[58] Field of Search ..... 60/643, 645, 652, 659, 60/670, 676; 126/400; 165/104.15, 104.18, 104.13

[56] References Cited

U.S. PATENT DOCUMENTS 3,219,105 11/1965 Nettel ..... 165/104.18

3,998,695 12/1976 Cahn et al. ..... 60/659 X 4,361,009 11/1982 Schluderberg ..... 60/659

*Primary Examiner*—Stephen F. Husar

*Attorney, Agent, or Firm*—Robert J. Edwards; James C. Simmons

[57] ABSTRACT

Apparatus and method for storing excess thermal energy of a fossil fuel-fired vapor generator during low demand periods and for recovering the stored thermal energy for use during high demand periods. A first moving bed heat exchanger is provided for flowing a bed of refractory particles in heat exchange relation with vapor generator flue gases to receive thermal energy therefrom. At least a portion of the bed of heated refractory particles is stored. A second moving bed heat exchanger is provided for flowing at least a portion of the bed of heated refractory particles in heat exchange relation with a fluid to impart thermal energy to the fluid for use.

17 Claims, 4 Drawing Figures

THERMAL ENERGY STORAGE AND RECOVERY APPARATUS AND METHOD FOR A FOSSIL FUEL-FIRED VAPOR GENERATOR

The present invention relates to energy storage. More particularly, this invention relates to a thermal energy storage and recovery apparatus for fossil fuel-fired vapor generators utilizing moving bed heat exchangers.

Electricity produced by an electric power generating plant must generally be consumed immediately. The demand for electricity from such a plant is not constant but varies throughout a 24 hour day. This has required electric power generating plants to be designed to operate over a range of production levels, and, moreover, to be capable of producing enough electricity to satisfy peak demands.

Designing a conventional plant to provide sufficient steam at the superheater outlets for peak load capacity is inherently uneconomical in that plant construction costs are proportional to capacity. Ideally, the plant, in addition to being constructed for use of an economical fuel, could be constructed at average load level capacity thereby avoiding the higher construction costs for peak capacity, if peak demands could be met by some supplemental source. Presently available sources of supplemental energy for use during peak demand periods include diesel engines, additional fossil fuel-fired steam turbine-generators, and pumped hydro power.

The conventional medium for transporting energy for operating a turbogenerator or for use in industrial processes has been and is expected to continue to be high temperature steam. While steam can be superheated to high temperatures to improve Rankine cycle efficiencies, if there is an attempt to exchange heat from the steam to a non-phase changing fluid for storage, such as where thermal energy is stored in the range of 500–600 degrees Farenheit, the change in phase of the steam to water inherently limits the amount of thermal energy that can be recovered for use at a later time since large amounts of heat are lost due to the thermodynamic irreversibilities associated with the heat transfer between phase-changing and non-phase changing fluids. These heat losses are illustrated by the temperature-entropy graph of FIG. 1 wherein line 10 represents the temperature-entropy relationship of steam conventionally used for an efficient Rankine cycle. However, in this diagram, the steam is illustrated as being used for charging of a storage medium. Line 12 represents the temperature-entropy relationship for receipt of energy by a non-phase changing storage medium for storage, and line 14 represents the temperature-entropy relationship for receipt of energy by steam/water from the storage medium. As illustrated by cross-hatched area 16, a substantial amount of the available steam energy is lost during the charge mode during which the steam yields its latent heat to the storage medium. During energy recovery, the single phase storage medium yields its charge to produce low pressure steam but again with losses illustrated by the cross hatched area 18. Both losses are the result of irreversible thermodynamic processes. Thus, both energy transfer processes are limited by what are commonly called "pinch points" between the temperature of a storage medium and the two saturation temperatures, as shown in FIG. 1. The result is steam generation at line 14 which can generate power only at a significantly lower Rankine cycle efficiency than the steam generation at line 10.

Thermal energy storage is difficult and uneconomic with steam-only cycles wherein steam or water is used as the storage medium since energy storage in steam or water involves an irreversible thermodynamic process of a phase change of flashing from high saturation temperatures, thus requiring the use of high pressure accumulators. Oil or other fluids either alone or when combined with rocks may tend to degrade resulting in high maintenance expenses.

The use of molten salts or liquid metals as a storage medium results in containment and environmental problems. Among these is the continual requirement of keeping the molten salt or liquid metal in a fluid state in all tube passages and storage areas. A breakdown in the plant, forcing even a temporary shutdown, may cause the solidification of the molten salt or liquid metal resulting in extremely difficult problems for restarting the plant. In addition, molten salt is corrosive to the usual metal surfaces with which the molten salt may come in contact. Molten metal such as liquid sodium can be dangerous when brought in contact with air or water.

It is desirable to provide a thermal energy storage and recovery apparatus for a fossil fuel-fired vapor generator wherein the disadvantages of the prior art are eliminated. It is desirable to eliminate the large energy losses associated with transferring energy from a phase changing fluid to a non-phase changing storage medium and from the non-phase changing storage medium to water to generate steam for power generation. It is also desirable to eliminate the disadvantages associated with using water or steam as the storage medium.

Accordingly, it is an object of the present invention to provide a method and apparatus for storing and recovering thermal energy provided by a fossil fuel-fired vapor generator wherein the Rankine cycle inefficiencies associated with delivery of thermal energy from a phase changing fluid to a non-phase changing medium for storage and recovery are eliminated.

It is another object of the present invention to provide, for use in a thermal energy storage and recovery apparatus as a storage medium, a material which is inexpensive, environmentally safe, non-corrosive, and does not present serious operating problems at temperatures either above or below normal operating temperatures of the plant.

It is yet another object of the present invention to provide for transfer of thermal energy to such a material for generation of power at high Rankine cycle efficiencies.

It is yet another object of the present invention to avoid the difficulties mentioned above while eliminating the economically unattractive alternatives of the prior art in order to provide a significant advantage for reliable thermal energy storage in a power generating plant served by a fossil fuel-fired vapor generator.

It is another object of the present invention to provide a high temperature thermal energy storage and recovery system for a fossil fuel-fired vapor generator which is simple in design, rugged in construction, economical to manufacture, and economical to operate.

The various features of novelty which characterize the invention are pointed out with particularity in the claims annexed to and forming a part of this disclosure. For a better understanding of the invention, its operating advantages, and specific objects attained by its uses, reference is made to the accompanying drawings and descriptive matter in which a preferred embodiment of the invention is illustrated.

IN THE DRAWINGS

Figure 2:
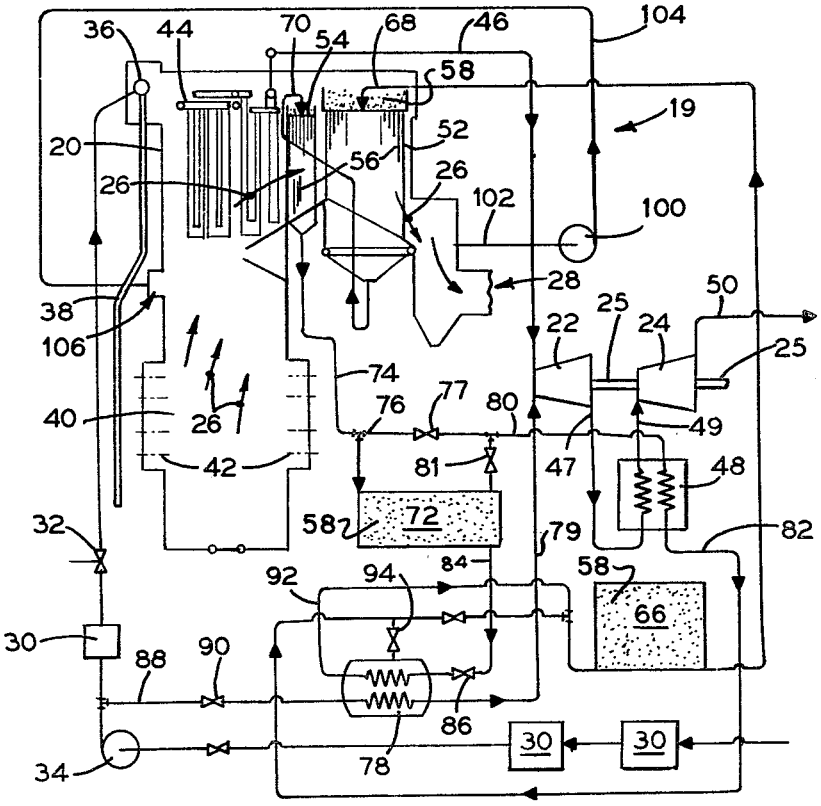
FIG. 2 is a schematic of a power generating plant that includes a fossil fuel-fired vapor generator and a thermal energy storage and recovery apparatus embodying the present invention.

Referring to FIG. 2, there is shown generally at 19 a plant which includes a coal-fired steam generator 20 which is used to provide steam to high pressure and low pressure turbines 22 and 24 respectively (hereinafter called which HP and LP turbines) which commonly operate on a common shaft 25 and which may act as a prime mover for an electrical generator or a ship's propellor or provide motive power for some other purpose. It should be understood that this invention embodies not only coal-fired steam generators, but it may embody and its scope is meant to include oil-fired, gas-fired, refuse derived fuel-fired, and other types of fossil fuel-fired steam generators which utilize thermal energy in flue gas to heat steam or other vapors as the flue gas flows along a predetermined path through the vapor generator to an exit point. It should also be understood that this invention is not limited to just steam generators, but includes various other vapor generators. The path of flow of flue gas through the steam generator 20 is illustrated by the arrows at 26. The flue gas exits from the steam generator 20 at a location illustrated at 28 afterwhich it may pass through an air heater (not shown) and other conventional equipment such as polution control equipment before exiting up the stack to the atmosphere.

In a conventional manner, water is routed through regenerative feed water heaters illustrated at 30 and to feed pump 34 which discharges the heated water through another feed water heater 30 and a feedwater control valve 32 at a pressure slightly higher than the pressure in the steam generator 20 to the steam generator drum 36. The water is then circulated through downcomer 38 and through conventional furnace steam generating tubes (not shown) back to the drum 36. During this process, heat from the burning of a fossil fuel by burners illustrated schematically at 42 in the furnace illustrated at 40 is imparted to this water to form saturated steam. This saturated steam is separated from the water in the drum 36 and is delivered to a platen superheater 44 where the saturated steam is superheated and then delivered through line 46 to HP turbine 22. The superheated steam is expanded in the HP turbine 22 to do work afterwhich it is exhausted to reheater 48 through line 47. Additional thermal energy is added to the steam in the reheater 48 as will be described hereinafter afterwhich the reheated steam is delivered to the LP turbine 24 through line 49 where it is again expanded to perform work and is exhausted through line 50 to a conventional condenser (not shown) afterwhich the condensed steam may then be returned to the feed water heaters 30, and the cycle is repeated.

It may be desirable to operate the steam generator 20 continually at a constant load 24 hours a day. In addition to the economic benefits in siting and building lower capacity boilers to serve higher capacity turbine generators, there are other benefits which are also considered to make such an operation desirable. While coal-fired steam generators and associated turbines can be cycled on and off-line each day, the cycling of scrubbers, bag houses, and precipitators results in complications and difficulties. If additional superheater capacity and an economizer as well as the reheater 48 were disposed in the path of flue gases through the steam generator 20 so as to provide increased steam output from heat exchange directly with the flue gases and if part of the steam output were then used to impart thermal energy to a non-phase changing thermal energy storage medium for recovery during periods of high load demand, this would result in the previously described Rankine cycle inefficiencies. In order to provide thermal energy storage and recovery for such a fossil fuel-fired vapor generator wherein such Rankine cycle inefficiencies are eliminated, there is provided in accordance with the present invention a first moving bed heat exchanger means adapted to receive thermal energy directly through heat exchange with the flue gas. Such a first moving bed heat exchanger means is illustrated in FIG. 2 and preferably comprises a primary first heat exchanger 52 and a secondary first heat exchanger 54 upstream thereof relative to the flue gas flow. The first moving bed heat exchangers 52 and 54 are preferably disposed in the flue gas path 26 to eliminate requirements of providing costly ductwork otherwise required for routing of flue gases between the heat exchangers 52 and 54 and the flue gas spaces. The heat exchangers 52 and 54 are preferably located downstream of but adjacent the superheater 44 relative to flue gas flow and upstream of the air heater (not shown). As illustrated and as indicated by arrows 26 in FIG. 2, each of the first moving bed heat exchangers 52 and 54 is open to the flow of flue gas into and out of the heat exchangers to flow in cross-flow heat exchange relation with thermal energy storage media flowing through conduits schematically illustrated at 56 which extend preferably vertically to permit gravity feed of thermal energy storage media therethrough. Steam generator 20 may be a newly constructed steam generator or it may be a steam generator which has been retrofitted by removing a secondary superheater, sections of a primary superheater, an economizer, and a reheater and providing the first heat exchangers 52 and 54 in their stead.

In order to provide a thermal energy storage medium that is inexpensive, environmentally safe, non-corrosive, and does not present operating difficulties if its temperature drops to substantially less than normal operating temperatures, in accordance with the present invention the thermal energy storage medium for flowing through the first moving bed heat exchanger means 52 and 54 in heat exchange relation with the flue gases is a moving bed of sand or other refractory particles which remain in the form of granulated solids throughout the temperatures normally experienced with the steam generator 20 during operation and when shut down. By "moving bed" is meant granulated solids in a process vessel that are circulated (moved) either mechanically or by gravity flow. This is in contrast to a "fluidized bed" which is defined herein as a cushion of air or hot gas or liquid floating or otherwise conveying a powdered material through a process vessel. The free-flowing refractory particles illustrated at 58 are preferably spherical in shape, have a uniform size of preferably about 100 microns, and are of course preferably inexpensive. Acceptable materials include but are not limited to silica sand, barytes sand (barium sulfate), partially calcined clay, glass beads, and reclaimed petroleum catalysts. In the embodiment of the invention described herein, silica sand is used as the heat storage medium.

Figure 1:
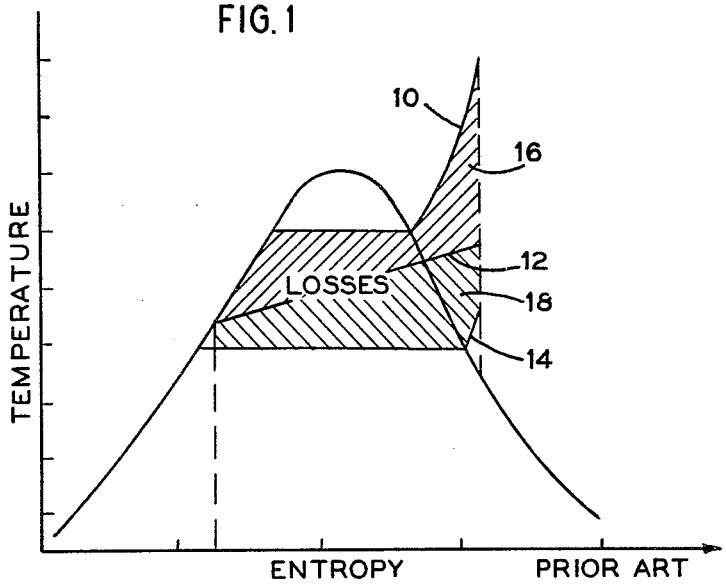
FIG. 1 is a temperature-entropy diagram illustrating the disadvantages of a prior art method of storing and recovering thermal energy.
Figure 3:
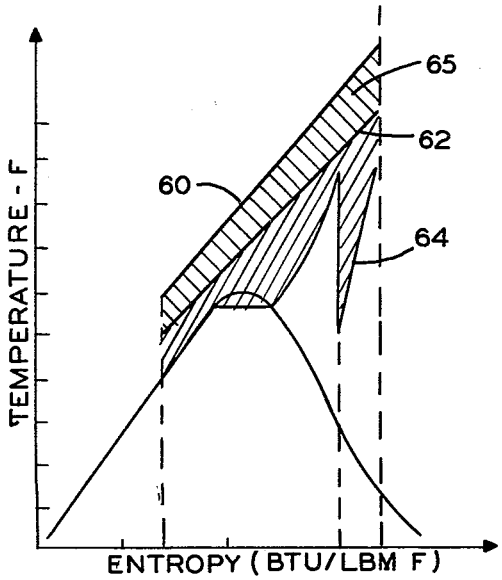
FIG. 3 is a temperature-entropy diagram illustrating the temperature and energy levels associated with transferring thermal energy from flue gas to sand and from sand to a Rankine power generating cycle in accordance with the present invention.

In contrast with the Rankine cycle inefficiencies illustrated in FIG. 1 which are experienced in heat exchange from steam to non-phase changing storage media, the improved Rankine cycle efficiencies which result when thermal energy is exchanged between hot flue gases and sand for heat storage is illustrated by the temperature-entropy graph of FIG. 3 wherein line 60 represents the temperature-entropy relationship of the flue gas as it imparts heat to sand, line 62 represents the temperature-entropy relationship of sand while receiving and delivering thermal energy, and 64 represents the temperature-entropy relationship of steam during a peak load condition receiving thermal energy from the sand. The lesser area illustrated by crosshatched portion 65 representing the irreversibilities from flue gases imparting thermal energy to the sand, when compared with the analagous area 16 in FIG. 1, illustrates the increased Rankine cycle efficiencies to be achieved by a thermal energy storage and recovery apparatus embodying the present invention.

Sand which has imparted its thermal energy to steam for use (hereinafter referred to as "exhausted sand") may be stored in reservoir 66. It may then be transported to the top of the primary first moving bed heat exchanger 52 by suitable means such as, for example, a belt, bucket conveyors, or a screw conveyor as schematically illustrated by line 68, at which point it is preferably gravity fed through conduit means 56 such as tubes to the bottom thereof in heat exchange relation with a cross flow of the flue gases. This heated sand is then transported as again shown schematically at 70 to the top of the secondary first moving bed heat exchanger 54 at which point is is again preferably gravity fed through conduits 56 to the bottom thereof in heat exchange relation with a cross flow of flue gases.

In accordance with the present invention, storage means such as sand high temperature reservoir 72 is provided for storing the bed of heated refractory particles 58 to which thermal energy has been imparted in the primary and secondary first moving bed heat exchangers 52 and 54 respectively. Preferably, the sand high temperature reservoir 72 is located below the secondary first moving bed heat exchanger 54 to allow gravity flow of the high temperature refractory particles as illustrated by line 74 to the reservoir 72.

Although part of the hot refractory particles 58 may be routed from reservoir 72 through line 80 and valve 81 to reheater 48, heated refractory particles 58 are preferably routed directly to the reheater 48 via line 76 and valve 77 thus by-passing the reservoir 72. Hot refractory particles are supplied to the reheater 48 preferably continuously, 24 hours a day, for steam reheat between the HP and LP turbines 22 and 24 respectively. The exhausted particles 58 are then routed via line 82 to reservoir 66 for reuse. The moving bed of hot refractory particles 58 passes through the reheater 48 in heat exchange relation with steam passing therethrough from the HP turbine 22 to reheat the steam. The reheater 48 is preferably disposed out of the flue gas path and adjacent the turbines 22 and 24 to eliminate lengthy steam piping runs and the resulting pressure losses which would occur if the reheater were conventionally located in the flue gas spaces and used heat directly from the flue gases to reheat the steam.

The remainder of the sand 58 is accumulated in the sand high temperature reservoir 72 during low load demand periods such as late at night to be delivered during high demand periods to a second moving bed heat exchanger means such as peak boiler 78 via line 84 and valve 86 to flow in heat exchange relation with water entering the peak boiler 78 via line 88 and valve 90 to thereby generate steam for delivery to the HP turbine 22 through line 79 to supplement steam being provided via line 46 to the HP turbine 22 from superheater 44. The exhausted sand from the peak boiler 78 may then be returned to the sand low temperature reservoir 66 via line 92. If desired, valve 94 may be provided to route sand from the reheater 48 to the peak boiler 78 for use of thermal energy in the sand which is still available after its passage through the reheater. Preferably, the reheater 48 and peak boiler 78 are disposed below the sand high temperature reservoir 72, and the sand low temperature reservoir 66 is disposed below the reheater 48 and peak boiler 78 to permit gravity flow of sand 58 from the sand high temperature reservoir 72 through the reheater 48 and peak boiler 78 to the sand low temperature reservoir 66 to eliminate the necessity for machinery for movement of the sand and the complications that may result therefrom.

A typical objective of a thermal energy storage and recovery apparatus embodying the present invention is a fossil fuel-fired steam generator having a fuel energy input or heat absorption capacity equal to about 65 percent of peak turbine capacity. The steam generator would be operated at its absorption capacity 24 hours per day with the turbine-generator operating at its full capacity for 8 to 12 hours and at approximately 30 to 45 percent of its capacity for the remainder of the day. The difference between the reduced capacity of the steam generator and the 100 percent turbine capacity at peak demand would be made up by use of steam generated in the peak boiler 78. The difference between the 30 to 45 percent turbine load during the off-peak hours and the steam generator capacity of 65 percent allows the build up of thermal energy storage in reservoir 72.

In a typical embodiment of this invention, the sand for a 600 megawatt plant is heated from about 300 to about 700 degrees Farenheit (422 to 644 degrees Kelvin) in the primary first heat exchanger 52. It is then delivered to the secondary first heat exchanger 54 where it is heated from about 700 degrees Farenheit (644 degrees Kelvin) to its final temperature of about 1300 degrees Farenheit (978 degrees Kelvin). Some of the high temperature sand is continually flowed to reheater 48. The remainder of the high temperature sand is stored in sand high temperature reservoir 72 until it is to be used. The transport by mechanical means of the low temperature sand from the low sand temperature reservoir 66 to the primary first moving bed heat exchanger 52 and of the partially heated sand to the secondary first moving bed heat exchanger 54 should not present difficulties since the sand is still at relatively low temperatures. After its delivery to the secondary first heat exchanger 54, the problem of transporting hot sand is avoided by advantageously using gravity flow of the charged sand.

Figure 4:
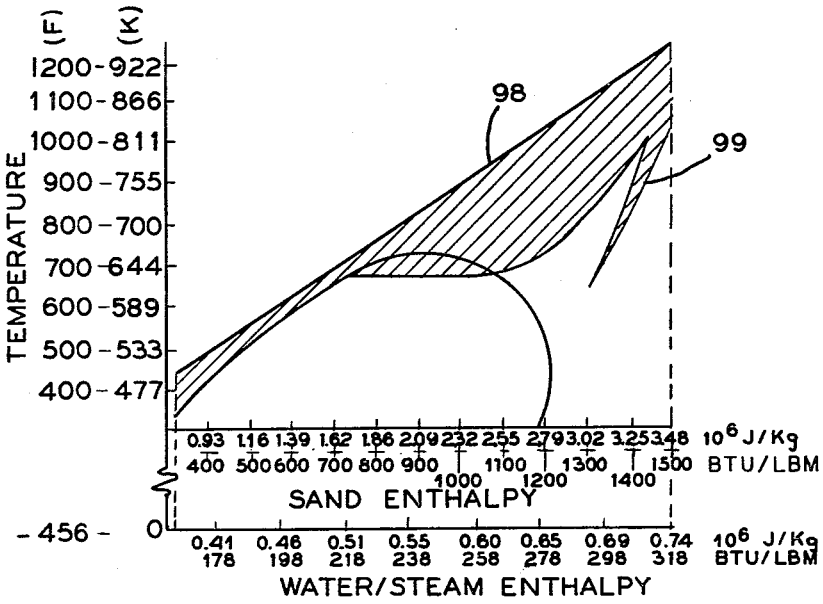
FIG. 4 is a temperature-enthalpy diagram illustrating heat exchange between high temperature sand and steam in accordance with the present invention.

Referring to FIG. 4, line 98 represents the temperature-enthalpy diagram for sand during discharge, and line 99 represents the temperature-enthalpy diagram for the peak boiler water/steam generation and use. Subcooled water is heated in the peak boiler 78 from a temperature of about 250 degrees Farenheit (395 degrees Kelvin) to a superheated temperature of about 950 degrees Farenheit (783 degrees Kelvin) suitable for delivery to the HP turbine 22. In addition, the reheater 48 reheats the entire quantity of steam exhausted from the HP turbine 22 to a temperature of about 950 degrees Farenheit (783 degrees Kelvin) suitable for delivery to the LP turbine 24.

Since the steam generator 20 is not required to provide peak load steam production at the superheater outlet, the furnace size may be reduced proportionately in accordance with engineering principles of common knowledge to those of ordinary skill in the art to which this invention pertains, and means are preferably provided for circulating tempering flue gas through the convection spaces in order to reduce steam production and to provide increased flue gas mass flow in the convection passes for increased convection pass heat absorption for transfer of heat to the refractory particles 58 without increasing the furnace exit gas temperature to a level where fuel ash particles may become molten slag and stick to convection heat transfer surfaces thus blocking narrow flue gas passages especially of those steam generators that are coal or oil-fired. By "gas tempering" is meant the recirculation of a portion of the cooler flue gases through the convection heat transfer surfaces. Such flue gas tempering means may include gas tempering fan 100 which receives a portion of the flue gas through line 102 from downstream of heat exchanger 52 and discharges the flue gas through line 104 to gas tempering ports at 106 upstream of the platen superheater 44. Typically, steam production may be reduced by perhaps 35.5 percent by circulating 25 percent tempering flue gas through the convection spaces.

The various flow rates of sand, steam, and flue gas and sizes of various apparatus members may be calculated by applying engineering principles of common knowledge to those of ordinary skill in the art to which this invention pertains.

As the temperature-entropy graph and temperature-enthalpy graph of FIGS. 3 and 4 respectively illustrate, an advantage of using high temperature single phase heat transfer media resides in its storage capability of working well above the critical temperature of water and thus above the most efficient Rankine cycles. The energy losses associated with the phase changes and "pinch points" occurring during both the charge and discharge modes are diminished as a result of shallower thermal gradients and the absence of "pinch points".

Since solidification of sodium occurs at about 208 degrees Farenheit (371 degrees Kelvin) and of molten salt at about 450 degrees Farenheit (505 degrees Kelvin), a significant advantage of the use of sand or other refractory particles for the heat storage medium is that there is no minimum temperature within the temperature ranges of operation or shut-down of the plant at which the sand has to be maintained. It is believed that significant erosion of heat exchanger tubes by flowing sand will not occur as long as the velocity of sand through the heat exchanger tubes is less than 5 feet per second.

A particular construction of a thermal energy storage and recovery apparatus in accordance with this invention can be designed using engineering principles of common knowledge to those of ordinary skill in the art to which this invention pertains. Certain features of this invention may sometimes be used to advantage without a corresponding use of the other features. It is also to be understood that the invention is by no means limited to the specific embodiments which have been illustrated and described herein, and that various modifications thereof may indeed be made which come within the scope of the present invention as defined by the appended claims.

What is claimed is:

1. A method for storing excess thermal energy of a fossil fuel-fired vapor generator and for recovering the stored thermal energy for use comprising:

a. flowing a moving bed of refractory particles in heat exchange relation with flue gases produced by the vapor generator to receive thermal energy from the flue gases;

b. storing at least a portion of the hot refractory particles; and c. flowing at least a portion of the moving bed of hot refractory particles in heat exchange relation with a fluid to impart thermal energy to the fluid for use.

2. A method according to claim 1 wherein the moving bed of refractory particles is flowed through a first moving bed heat exchanger means in heat exchange relation with the flue gases, and the method further comprises disposing the first moving bed heat exchanger means in a predetermined flue gas path through the vapor generator.

3. A method according to claim 2 further comprising disposing said first moving bed heat exchanger means in the vapor generator convection spaces and downstream of, relative to flue gas flow, and adjacent a superheater of the vapor generator.

4. A method according to claim 2 further comprising recirculating a portion of the flue gases from downstream of the first moving bed heat exchanger means through said first moving bed heat exchanger means.

5. A method according to claim 1 further comprising recirculating a portion of the flue gases in heat exchange relation with the moving bed of refractory particles.

6. A method according to claim 1 further comprising flowing at least a portion of the moving bed of hot refractory particles in heat exchange relation to the steam exhausted from a turbine to reheat the steam for delivery to a lower pressure turbine which step of reheating the steam is conducted at a location out of the vapor generator flue gas path and adjacent the turbines.

7. In a plant including a vapor generator which is fired by fossil fuel thereby producing flue gases which flow along a pre-determined path to an exit from the vapor generator, apparatus for storing excess thermal energy during low demand periods and for recovering the stored thermal energy for use during high demand periods, the apparatus comprising a first moving bed heat exchanger means for flowing a bed of refractory particles in heat exchange relation with the flue gases to receive thermal energy from the flue gases, storage means for storing at least a portion of the bed of heated refractory particles, and a second moving bed heat exchanger means for flowing at least a portion of the bed of heated refractory particles in heat exchange relation with a fluid to impart thermal energy to the fluid for use.

8. A plant according to claim 7 wherein said first moving bed heat exchanger means is disposed in said pre-determined flue gas path.

9. A plant according to claim 8 wherein said first moving bed heat exchanger means is disposed in the vapor generator convection spaces and downstream of, relative to flue gas flow, and adjacent a superheater of the vapor generator.

10. A plant according to claim 8 wherein the apparatus further comprises means for recirculating a portion of the flue gases from downstream of said first moving bed heat exchanger means through said first moving bed heat exchanger means.

11. A plant according to claim 7 wherein the apparatus further comprises means for recirculating a portion of the flue gases from downstream of said first moving bed heat exchanger means through said first moving bed heat exchanger means.

12. A plant according to claim 7 wherein the apparatus further comprises a reheater means for flowing the bed of hot refractory particles in heat exchange relation with vapor exhausted from a turbine to reheat the vapor for delivery to a lower pressure turbine, and said reheater is disposed out of the flue gas path and adjacent the turbines.

13. A plant according to claim 12 wherein said first moving bed heat exchanger means is disposed in said pre-determined flue gas path.

14. A plant according to claim 7 wherein said storage means is disposed below said first moving bed heat exchanger means, and said second moving bed heat exchanger means is located below said storage means.

15. A plant according to claim 14 wherein the apparatus further comprises a reservoir for exhausted refractory particles, and means for transporting exhausted refractory particles from said reservoir to said first moving bed heat exchanger means.

16. A plant according to claim 7 wherein the apparatus further comprises a moving bed of refractory particles for flowing through said first moving bed heat exchanger means in heat exchange relation with flue gases to receive thermal energy therefrom and for flowing through said second moving bed heat exchanger means in heat exchange relation with a fluid to impart thermal energy thereto.

17. A plant according to claim 7 wherein the vapor generator is a steam generator.

* * * * *